US005137485A

United States Patent [19]

Penner

[11] Patent Number: 5,137,485

[45] Date of Patent: Aug. 11, 1992

[54] TOY CONSTRUCTION SET WITH IMPROVED RADIAL AND AXIAL CONNECTABILITY AND EXPANDABILITY

[76] Inventor: V. John Penner, 3236 Denman St., Clearbrook, BC, Canada, V2T 4R5

[21] Appl. No.: 706,880

[22] Filed: May 29, 1991

[51] Int. Cl.[5] ..... A63H 33/08

[52] U.S. Cl. ..... 446/111; 446/120; 446/126; 446/127; 446/95

[58] Field of Search ..... 446/105, 120, 121, 126, 446/127, 111, 95, 124

[56] References Cited

U.S. PATENT DOCUMENTS

| | | | |
|---|---|---|---|
| 1,870,978 | 8/1932 | Wolfe | 446/105 |
| 2,313,357 | 3/1943 | Pajeau | 446/26 |
| 2,709,318 | 5/1955 | Benjamin | 46/26 |
| 2,885,822 | 5/1959 | Onanian | 46/26 |
| 3,415,008 | 12/1968 | Fischer | 446/127 X |
| 3,510,979 | 5/1970 | Fischer | 446/127 X |
| 3,924,376 | 12/1975 | Tsurumi | 446/115 X |
| 4,084,344 | 4/1978 | Asano | 46/28 |
| 4,159,592 | 7/1979 | Gabriel | 46/26 |
| 4,326,354 | 4/1982 | Hagberg | 46/26 |
| 4,348,830 | 9/1982 | Hagberg | 46/26 |
| 4,738,648 | 4/1988 | Berndt | 446/120 |

FOREIGN PATENT DOCUMENTS

| | | | |
|---|---|---|---|
| 854427 | 10/1970 | Canada . | |
| 867879 | 4/1971 | Canada . | |
| 927098 | 5/1973 | Canada . | |
| 933360 | 9/1973 | Canada . | |
| a1118599 | 2/1982 | Canada . | |
| 1222869 | 6/1987 | Canada . | |
| 1275173 | 10/1990 | Canada . | |
| 914948 | 12/1954 | Fed. Rep. of Germany | 446/105 |

*Primary Examiner*—Mickey Yu
*Attorney, Agent, or Firm*—John R. Flanagan

[57] ABSTRACT

A construction set for toys and like objects includes pluralities of different basic components. The basic components are a main strut member, an auxiliary strut member, an articulated strut member, an inline connector member, a panel member, and a wheel member. All components, except the panel member, can form identical connection joints with one another anywhere on multiple sides of the components. The panel member has main and auxiliary projections along opposite edges and protuberances mounted on one side of the panel on the main and auxiliary projections. The wheel member has inner and outer rings mounted to one another for relative rotation. The inner ring of the wheel member can receive one of the main strut members in an interfitted relationship.

20 Claims, 4 Drawing Sheets

TOY CONSTRUCTION SET WITH IMPROVED RADIAL AND AXIAL CONNECTABILITY AND EXPANDABILITY

BACKGROUND OF THE INVENTION

1. Field of the Invention

The present invention generally relates to toy construction sets and, more particularly, is concerned with a toy construction set composed of components providing improved radial and axial connectability and expandability.

2. Description of the Prior Art

Various types of toy construction sets have been proposed in the prior patent art. Representative examples of prior art construction sets are those disclosed in: Canadian Patents to Paksy (854,427), Meates (867,879), Howe (933,360), Pearce (927,098), Gabriel (1,118,599), Ziegler (1,222,869) and Lyman (1,275,173); and U.S. Pat. Nos. to Pajeau (2,313,357), Benjamin (2,709,318), Onanian (2,885,822), Asano (4,084,344), Gabriel (4,159,592) and Hagberg (4,326,354 and 4,348,830).

These prior art construction sets employ a variety of different components. Some construction sets have connector hubs with solid struts that connect at their opposite ends to the hubs. Examples are those sets disclosed in the Canadian patent to Pearce and U.S. patents to Benjamin and Hagberg. Other construction sets have thin solid bodies with edge connectors that form multisided models that enclose space. Examples are the set disclosed in the Canadian patent to Ziegler and a commercially-available set known as Googolplex. Another construction set, disclosed in the U.S. patent to Asano, has struts with various locking cavities on the ends that can make a framework.

There are also construction sets with wheels. The set disclosed in the Canadian patent to Meates has a hole in a round disc that slides onto a solid shaft. Two other sets, disclosed in Canadian patents to Howe and Lyman, have wheels with protruding shafts that fit into a bore in a separate building block.

Further, there are construction sets having blocks with a separate male connector that deflects to snap into a female receptacle in the blocks. U.S. patents to Onanian and Gabriel have this type of connector.

A significant shortcoming with respect to prior art toy construction sets which reduces the fun children can have playing with these sets is the limited variety of structures that can be constructed using the components of these sets. This shortcoming derives from the relatively restricted connectability of the components of the prior art sets. Consequently, a need exists for improvements which will overcome the shortcomings of these prior art construction sets.

SUMMARY OF THE INVENTION

The present invention provides a toy construction set designed to satisfy the aforementioned need. The set of the present invention satisfies a number of design goals which ensure that the set will be easy to use by children so that they can relatively easily construct a wide variety of things of their own choosing that are fun to play with. These design goals are as follows: (1) the construction set should have as few components as possible; (2) the components should connect together on all sides and along their entire lengths, or in other words, have a high degree of connectability; (3) the components of the set should be assembliable into frameworks expandable in multiple radial and axial directions, or in other words, have a high degree of expandability: (4) the set should include wheels that can be placed anywhere; and (5) the set should include attachable panels to enclose space.

In addition to achieving these goals, the toy construction set of the present invention has two main advantages over the prior art construction sets. First, it is simpler to assemble than most prior art sets because of the fewness of components. Second, and most important, it has far more connection possibilities on all components (except panels) than any prior art set, enabling the construction of a greater variety of structures.

Accordingly, the present invention is directed to a construction set which comprises: (a) a plurality of main strut members; (b) each of the main strut members being composed of an elongated body having a longitudinal axis and a pair of opposite ends, and including a pair of protrusions; (c) the body defining a plurality of longitudinal releasable locking channels extending between the opposite ends of the body and angularly spaced from one another circumferentially about the body and aligned generally parallel to and along the longitudinal axis of the body; (d) each protrusion being mounted to the body adjacent to one of the pair of opposite ends of the body, one of the protrusions of one main strut member being capable of snapping into and unsnapping from a connection joint with the channel of another main strut member at any location along the channel.

More particularly, each protrusion is composed of an outer tip of wedge-shaped cross-sectional configuration and an inner base of semi-cylindrical cross-sectional configuration, the inner base being of maximum width tapering to the outer tip of minimum width. Opposite edges of each of the channels of the body are spaced apart from one another through a distance greater than the minimum width of the outer tip of the protrusion but less than the maximum width of the inner base of the protrusion.

The construction set also comprises a plurality of auxiliary strut members, a plurality of articulated strut members and a plurality of inline connector members. Each auxiliary strut member has a body with locking channels and protrusions that are substantially identical to those of the main strut members. The auxiliary strut members are shorter in length than the main strut members. Each articulated strut member has opposite body portions with locking channels and protrusions substantially identical to those of the main strut member. Unlike the main strut members, the articulated strut members have hinges attached to and pivotally connecting the opposite body portions. Also, the articulated strut members are shorter in length than the main strut members. Each inline connector member has a body without protrusions but with locking channels substantially identical to those of the main strut member. The inline connector members are shorter in length than the main strut members.

The construction set further comprises a plurality of panel members and a plurality of wheel members. The panel members have a flat wall of generally square configuration defining two pairs of opposing edges, and includes a plurality of main and auxiliary projections on the opposing edges of the flat wall. Two panel members can be placed edge-to-edge with one another with the main projection of one panel member mated with the auxiliary projections of the other panel member. The panel members have protuberances mounted on the main and auxiliary projections to permit connection of the panels to the main, auxiliary and articulated strut members. Each protuberance has an outer spherical head capable of snap fitting into and from channels on the strut members.

Each wheel member is composed of inner and outer rings mounted to one another for relative rotation about an axis of the wheel member. The inner ring is capable of receiving one of the main or auxiliary strut members in an interfitted relationship anywhere along the length of the strut member. The outer ring is composed of a circular hub and a plurality of locking channels being identical to the channels of the main or auxiliary strut member such that the channels of the wheel member can receive the protrusions of the strut member to form an identical connection joint therewith.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PREFERRED EMBODIMENTS

Figure 1:
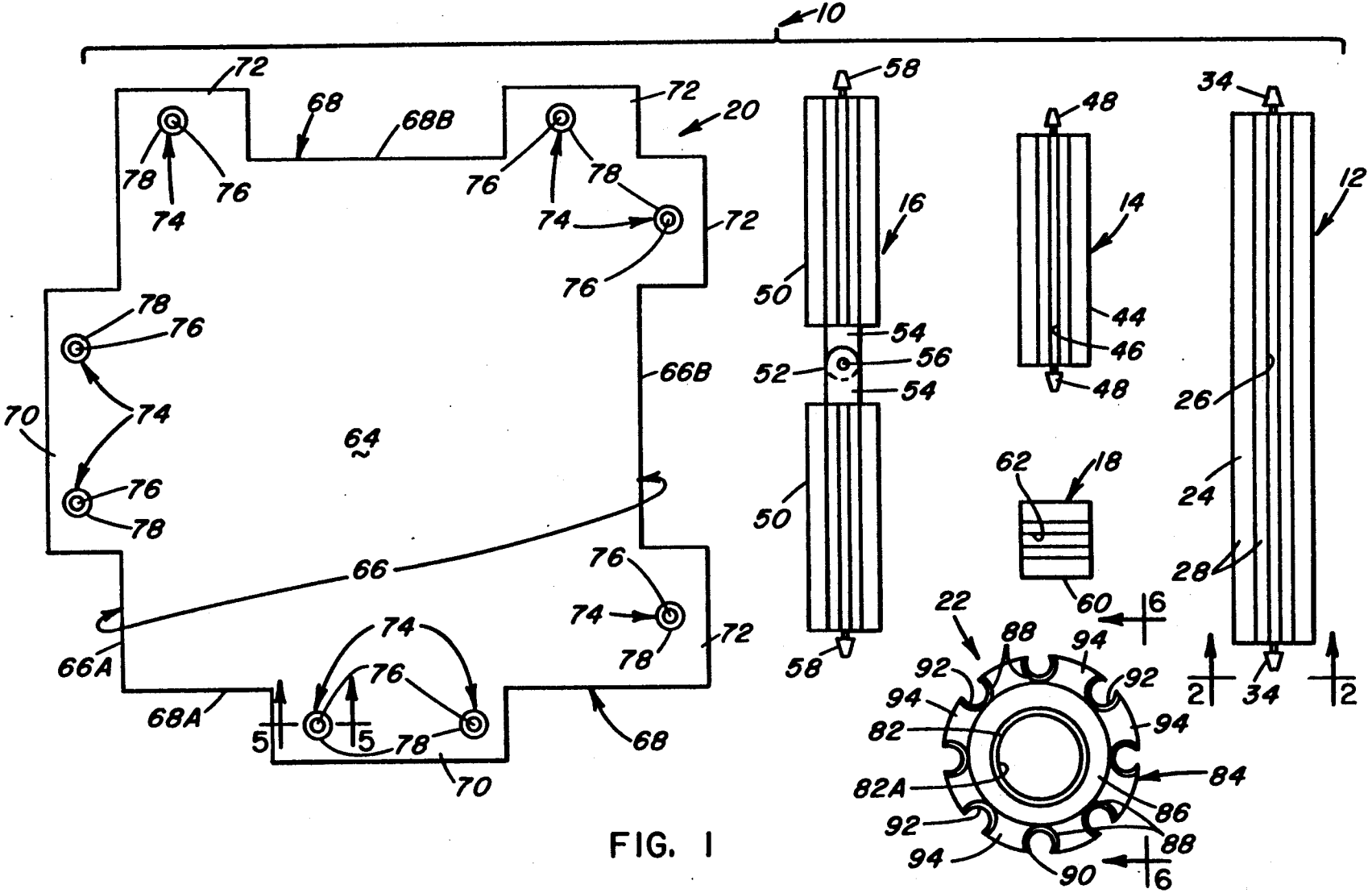
FIG. 1 is a side elevational view of the different basic components of a toy construction set comprising the present invention, namely a main strut member, an auxiliary strut member, an articulated strut member, an inline connector member, a panel member, and a wheel member.

Referring to the drawings, and particularly to FIG. 1, there is illustrated the different basic components of a toy construction set, generally designated 10, of the present invention for constructing toy structures. The different basic components, preferably six in number, are a main strut member 12, an auxiliary strut member 14, an articulated strut member 16, an inline connector member 18, a panel member 20, and a Wheel member 22. The construction set 10 includes pluralities of these different basic components.

Figure 2:
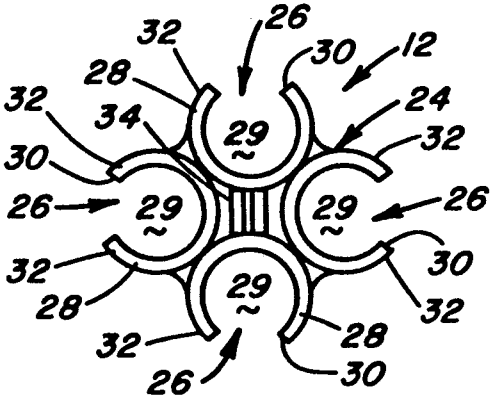
FIG. 2 is an enlarged end view of the main strut member of the set as seen along line 2—2 of FIG. 1.

Referring to FIGS. 1 and 2, the main strut member 12 of the construction set 10 is composed of an elongated body 24 defining four longitudinal releasable locking channels 26, angularly displaced preferably ninety-degrees from one another, and aligned generally parallel to, radially outwardly from, and along the longitudinal axis A of the body 24. In the illustrated embodiment of the main strut member 12, the elongated body 24 is in the form of four cylindrical hollow tubes 28 being adhered together in back-to-back relation. It should be realized that the elongated body 24 could be fabricated as a one-piece molded plastic part.

Each tube 28 has a longitudinal central passage 29 and slot 30 extending between the opposite open ends of the tubes 28. The longitudinal slot 30 is defined by opposing longitudinal lips or edge portions 32 in the cylindrical wall of the tube 28. The passages 29 and slots 30 of the respective tubes 28, which define the channels 26 are located at twelve, three, six and nine o'clock positions as viewed in FIG. 2 at the end of the main strut member 12, are located in the same positional sequence about the body 24 as the individual tubes 28. The longitudinal edge portions 32 are spaced apart from one another through a distance equivalent to approximately forty-five degrees of the circumference of the tube 28, providing the tube 28 and its channel 30 with a C-shaped cross-sectional configuration that faces radially outward from the longitudinal axis A.

Also, the main strut member 12 includes a protrusion 34 mounted adjacent to each of the opposite ends of the elongated body 26 by a pair of rigid posts 36 (FIG. 3) anchored to and extending axially from each opposite end of the body 26. Each protrusion 34 overall is of wedge-shaped cross-sectional configuration. The protrusion 34 has an inner base 34A of semi-cylindrical cross-sectional configuration and an outer tip 34B of wedge-shaped cross-sectional configuration. The inner base 34A is of maximum width tapering to the outer tip 34B of minimum width. It should be realized that the protrusions 34 could be fabricated by being molded integrally with the elongated body 26.

Figure 3:
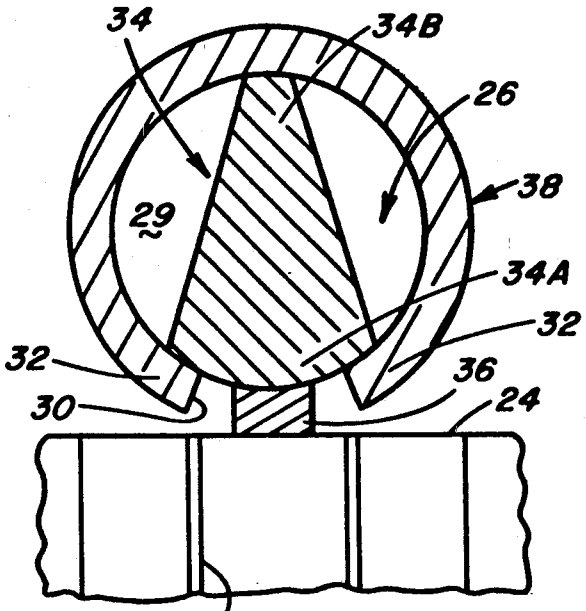
FIG. 3 is an enlarged fragmentary cross-sectional view of the connection joint between a pair of the main strut members.

Referring to FIG. 3, there is illustrated a connection joint 38 formed between one protrusion 34 on the end of one main strut member 12 and one locking channel 26 on another main strut member 12. The minimum width of the outer tip 34B of the protrusion 34 is less than the distance between the opposing longitudinal edge portions 32 of the tube 28 defining the longitudinal slot 30 of the locking channel 26. On the other hand, the maximum width of the inner base 34A of the protrusion 34 is greater than the distance between the tube longitudinal edge portions 32.

The protrusion 34 is preferably composed of a suitable rigid inelastic plastic material, whereas the tube 28 is preferably composed of a suitable semi-rigid semiflexible plastic material. The tube 28 must be sufficiently flexible to permit deflecting of the longitudinal edge portions 32 of the tube 28 away from one another and expansion of tbe slot 30 to allow the wedge-shaped outer tip 34B and semi-cylindrical inner base 34A of the protrusion 34 to be forced through the slot 30 of the tube 28 into and from the locking channel 26 and thereby to be snapped into and unsnap from the connection joint 38 between the locking channel 26 and protrusion 34. The material of the tube must be sufficiently resilient and rigid, however, such that the deflected longitudinal edge portions 32 of the tube 28 quickly return to their original shape and tightly grip partially around the semi-cylindrical base 34A after seating of the protrusion 34 within the locking channel 26.

Figure 4:
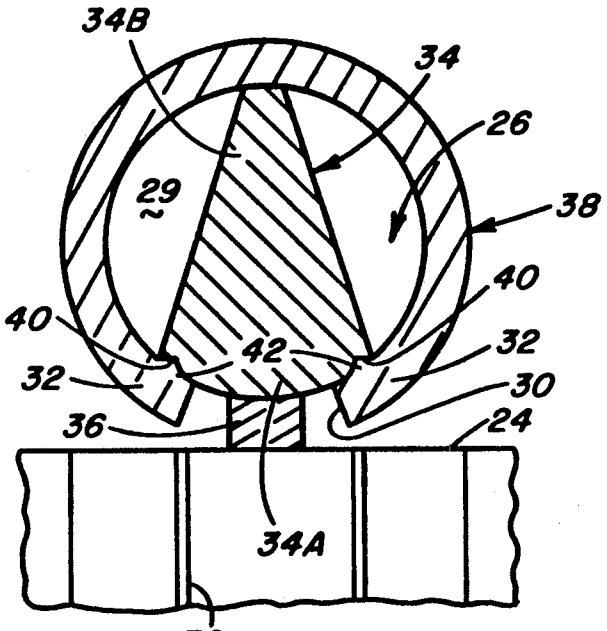
FIG. 4 is a view similar to that of FIG. 3 showing a modified form of the connection joint.

Referring to FIG. 4, in a modified form of the connection joint 38, the semi-cylindrical base 34A of the protrusion 34 and the interior surface portions of the tube 28 adjacent to the longitudinal edge portions 32 thereof have respective grooves 40 and ridges 42 which interfit with one another when the protrusion 34 is snapped into the locking channel 26. This interfitting relation between the grooves 40 and ridges 42 stabilizes the connection joint 38 by preventing lateral side-to-side pivotal movement or "play" between the protrusion 34 and channel 26 along their contacting semi-cylindrical surfaces, as can occur with respect to the connection joint 38 of FIG. 3.

Referring again to FIG. 1, the auxiliary strut member 14 of the construction set 10 is composed of an elongated body 44 defining four longitudinal releasable locking channels 46 aligned generally parallel to, radially outwardly from, and along the longitudinal axis B of the body 44. The auxiliary strut member 14 also includes a pair of protrusions 48. The channels 46 and protrusions 48 of the auxiliary strut member 14 are substantially the same in cross-sectional configurations and sizes as the channels 26 and protrusions 34 of the main strut member 12. The only difference from the main strut member 12 is that the length of the auxiliary strut member 14 is less than one-half of the length of the main strut member such that when two auxiliary strut members 14 are coupled together by an inline connector member 18 the overall length of the three pieces equals the length of the main strut member 12.

Referring again to FIG. 1, the articulated strut member 16 of the set 10 is composed of a pair of opposite body portions 50 each being identical to the body 44 of one auxiliary strut member 14. The articulated strut member 16 also includes a hinge 52 composed of a pair of tabs 54 and a coupling pin 56 pivotally connecting the tabs 54 together at their free ends. Each tab 54 is rigidly mounted to and extends axially from an end of a respective one of the body portions 50. The other end of each body portion 50 mounts a protrusion 58 identical to the protrusions 34 and 48 of the main and auxiliary strut members 12 and 14. The overall length of the two body portions 50 and the hinge 52 of the articulated strut member 16 equals the length of the main strut member 12. The pivotal axis C of the hinge 52 is preferably located at the midpoint of the length of the articulated strut member 16.

Referring again to FIG. 1, the inline connector member 18 of the construction set 10 is composed of an elongated body 60 defining four longitudinal releasable locking channels 62 aligned generally parallel to, radially outwardly from, and along the longitudinal axis D of the body 60. The locking channels 62 of the inline connector member 18 are substantially the same in cross-sectional configurations and sizes as the locking channel 26 of the main strut member 12. The only difference from the main strut member 12 are that the inline connector member 18 is approximately one-eight of the length of the main strut member 12 and has no protrusions on its opposite ends.

Referring again to FIG. 1, the panel member 20 of the construction set 10 is a solid flat wall 64 of generally square configuration defining two pairs 66, 68 of opposing edges. The panel member 20 is preferably composed of a suitable rigid plastic material and includes a plurality of main projections 70 and auxiliary projections 72 provided about the periphery of the wall 64 and in the plane of the wall 64. More particularly, preferably, in each pair 66, 68 of opposing edges, a main projection 70 is formed at a central location on each of the edges 66A, 68A thereof adjacent to one another and a pair of auxiliary projections 72 are formed at respective opposite end locations on each of the other edges 66B, 68B thereof adjacent to one another. The distance between the pair of auxiliary projections 72 is slightly greater than the length of one main projection 70 so that two panel members 20 can be placed edge-to-edge next to one another with the main projection 70 of one panel member 20 mated with the pair of auxiliary projections 72 of the other panel member 20. When the panel members 20 are assembled together in a plane, there is sufficient space left between auxiliary projections 72 at corners formed by adjacent panels 20 to accommodate strut members extending at right angles to the plane of the panel members 20.

Figure 5:
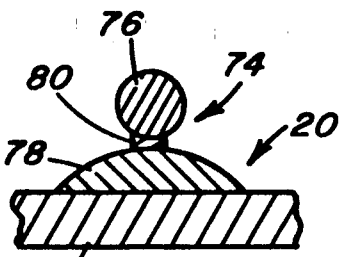
FIG. 5 is an enlarged fragmentary cross-sectional view of the panel member of the set taken along line 5—5 of FIG. 1, illustrating one of the protuberances on the panel member.

Referring to FIGS. 1 and 5, the panel member 20 also includes a plurality of protuberances 74 mounted on one side of the panel member 20 for connecting the panel member 20 to various arrangements of the main strut member 12, auxiliary strut member 14, articulated strut member 16 and/or inline connector member 18. Preferably, a pair of the protuberances 74 are mounted in spaced relation from one another on each main projection 70 and a single protuberance 74 is mounted on each auxiliary projection 72. As seen in FIG. 5, each protuberance 74 has an outer spherical head 76, and inner hemispherical base 78 substantially larger in diameter than the outer head 76 and attached to the respective projections 70, 72, and a cylindrical neck 80 rigidly connecting the head 76 to the base 78. The head 76 is shaped and sized to snap fit through the slots and into the channels on the main, auxiliary and articulated strut members 12, 14, 16 and on the inline connector member 18.

Figure 6:
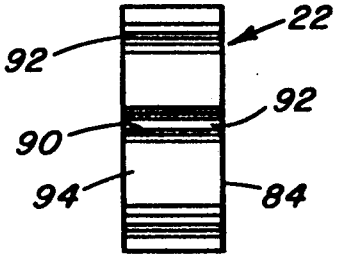
FIG. 6 is an end view of a wheel member of the set as seen along line 6—6 of FIG. 1.

Referring to FIGS. 1 and 6, the wheel member 22 of the construction set 10 is composed of inner and outer rings 82, 84 being mounted to one another for relative rotation about an axis E. The inner ring 82 can serve as a stationary axle for the rotatable outer ring 84. The inside surface 82A of the inner ring 82 will receive any of the main, auxiliary and articulated strut members 12, 14 and 16 in a friction fitted relationship anywhere along their respective lengths. The outer ring 84 will then rotate freely about the inner ring 82 and respective strut member, while the inner ring 82 remains motionless on the strut member.

The outer ring 84 is composed of an inner hub 86 and a plurality of eight tubes 88 symmetrically mounted about the hub 86. The tubes 88 have longitudinal slots 90 and define locking channels 92 which are identical in size and configuration to those of the main, auxiliary and articulated strut members 12, 14 and 16, and therefore can receive the protrusions 34, 48 and 58 of such members to form an identical connection joint therewith. The space between the tubes 88 is occupied by material providing tire treads 94.

Referring to FIGS. 7–12, there is illustrated examples of several arrangements which can be formed by different combinations of the main strut members 12, auxiliary strut members 14, articulated strut members 16, inline connector members 18, wheel members 20 and panel members 22 of the construction set 10 of the present invention. Duplications, variations and expansions of these arrangements are employed in the construction of a wide variety of different structures using the toy construction set 10. A few examples of such structures are a table and chairs, a bridge, a house, a tower, a box, a wheeled vehicle, and a helicopter.

Figure 8:
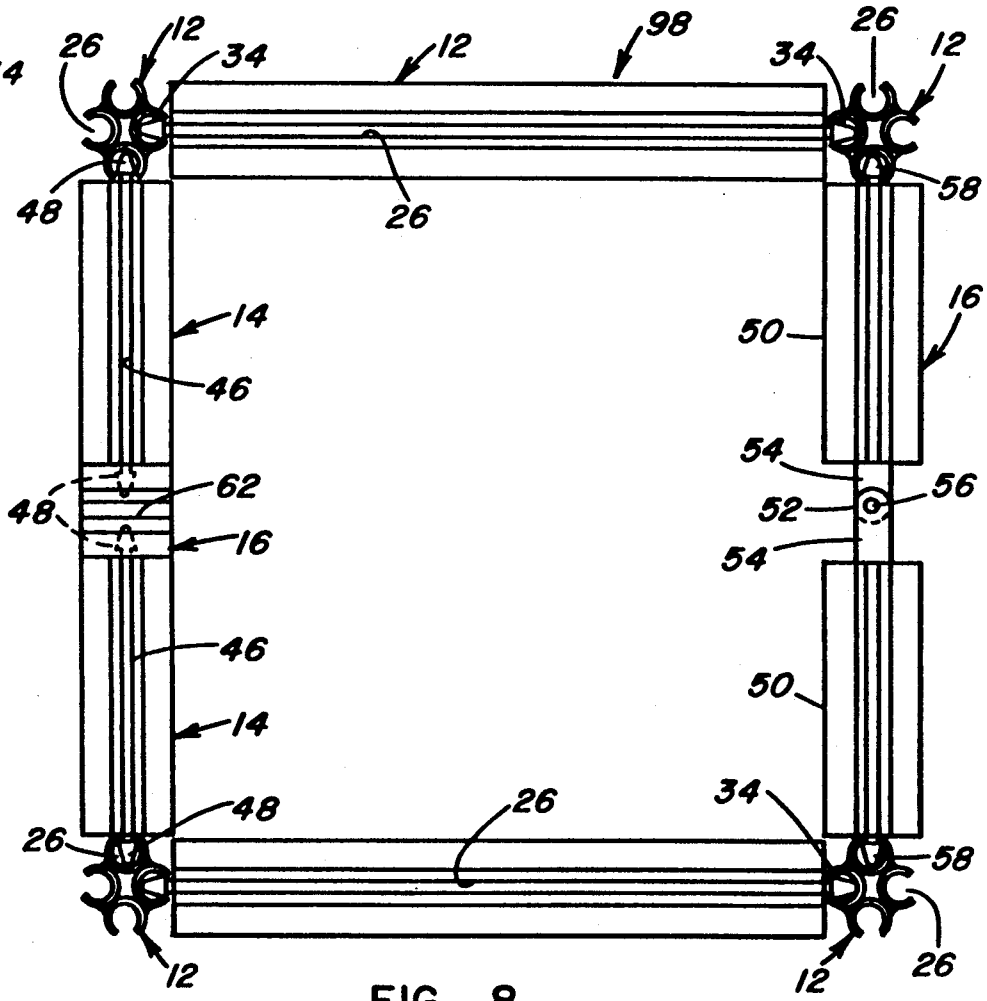
FIG. 8 is a side elevational view of an arrangement formed by a plurality of the main strut members, auxiliary strut members, inline connector members, and an articulated strut member of the set.
Figure 7:
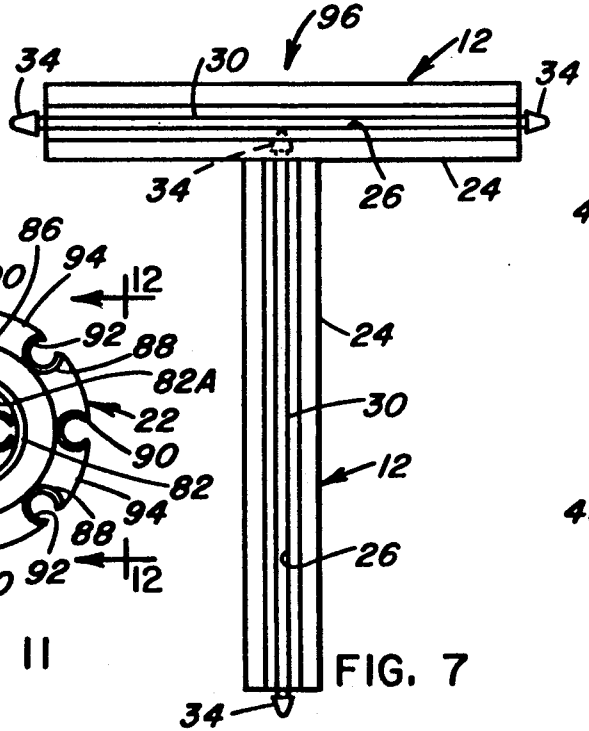
FIG. 7 is a side elevational view of an arrangement formed by a pair of the main strut members connected in orthogonal relation to one another.
Figure 11:
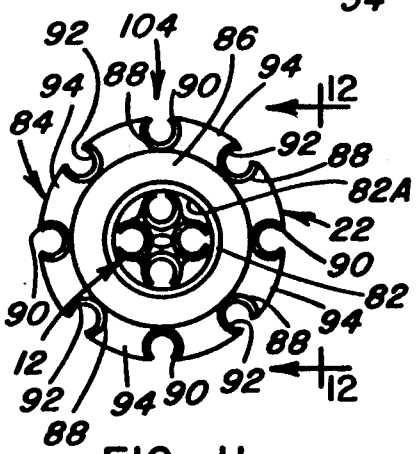
FIG. 11 is an end elevational view of a mobile arrangement formed by a pair of the wheel members and one main strut member of the set.
Figure 12:
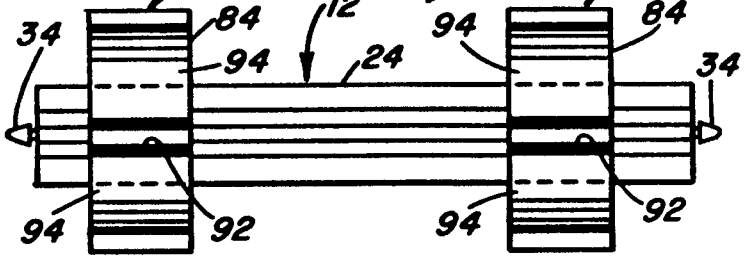
FIG. 12 is a side elevational view of the mobile arrangement as seen along line 12—12 of FIG. 11.
Figure 9:
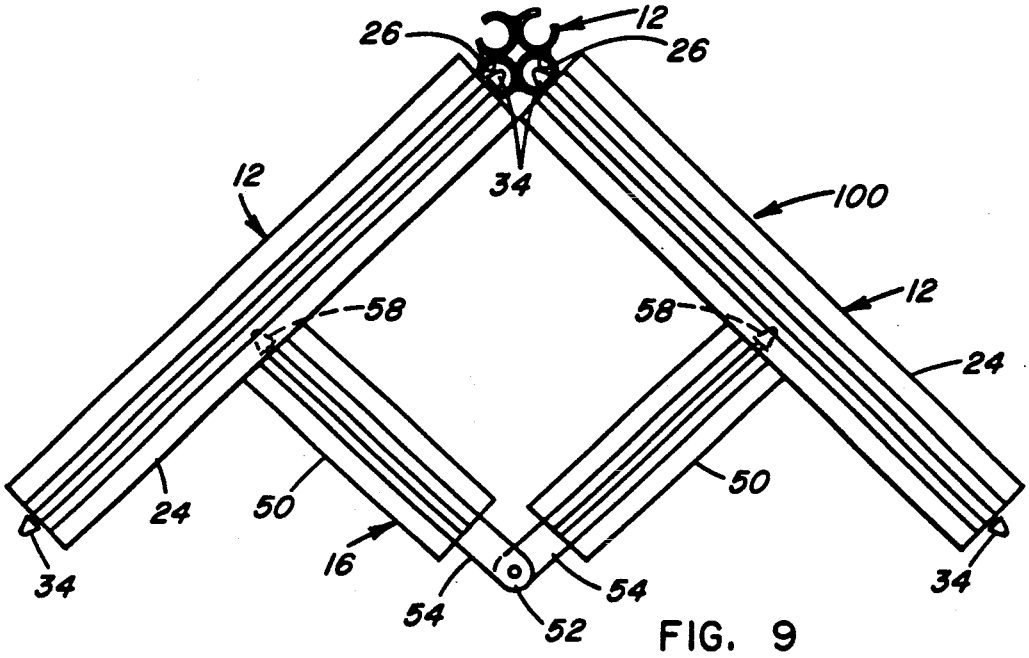
FIG. 9 is a side elevational view of an arrangement formed by a pair of the main strut members connected to a third main strut member aligned in transverse relation to the pair of main strut members and by an articulated strut member interconnecting the pair of main strut members so as to reinforce a corner form by them.
Figure 10:
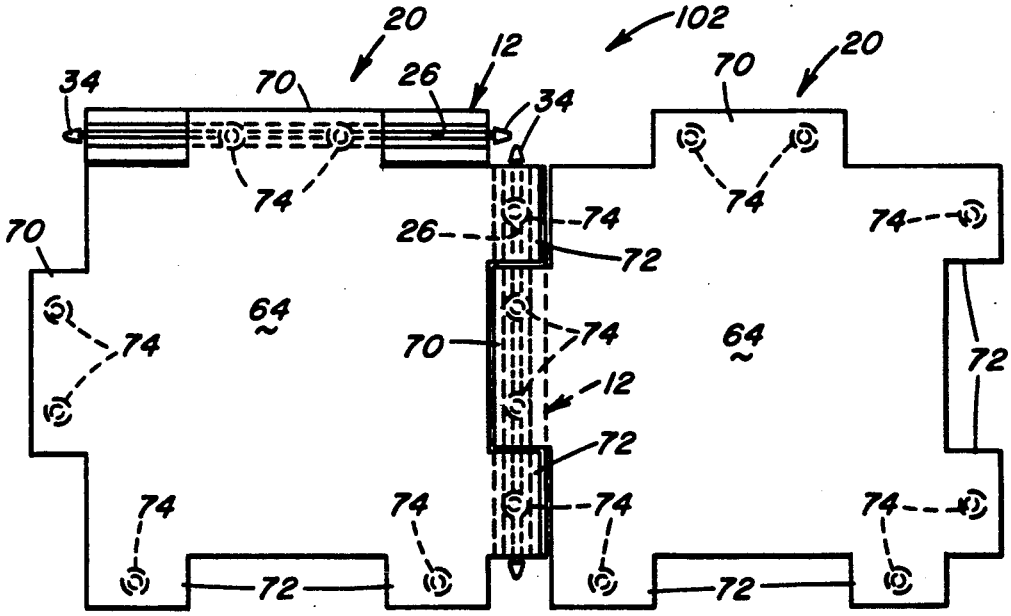
FIG. 10 is a side elevational view of an arrangement formed by a pair of the panel members and main strut members of the set.

FIG. 7 illustrates an arrangement 96 formed by a pair of the main strut members 12 connected in orthogonal relation to one another. FIG. 8 illustrates another arrangement 98 formed by a plurality of the main strut members 12, auxiliary strut members 14, inline connector members 18, and an articulated strut member 16 of the set 10. FIG. 9 illustrates still another arrangement 100 formed by a pair of the main strut members 12 connected to a third main strut member 12 aligned in transverse relation to the pair of main strut members 12 and by an articulated strut member 16 interconnecting the pair of main strut members 12 so as to reinforce a corner form by them. FIG. 10 illustrates Yet another arrangement 102 formed by a pair of the panel members 20 and main strut members 12 of the set 10. FIGS. 11 and 12 illustrate a mobile arrangement 104 formed by a pair of the wheel members 22 and a main strut member 12 of the set 10.

In summary, the components of the construction set 10 of the present invention are few in number, but versatile, and incorporate simple, easy-to-complete connection joints. A high degree of connectability is incorporated by all components (except the panel member 20) such that one component can attach to another one anywhere on six sides. Also, all components of the set 10 permit infinite expandability in six directions. Further, versatile wheel members 22 can be fitted anywhere in the structures constructed using the components of the set 10. Finally, the interlocking attachable panel members 20 are provided to make surface areas, strengthen the structures constructed using the other components of the set 10, and to enclose space. All of these components together form a highly adaptable construction toy set that allows assembly of a wide variety of structures.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A construction set, comprising:

(a) a plurality of main strut members;

(b) each of said main strut members being composed of an elongated body having a longitudinal axis and a pair of opposite ends, and including a pair of protrusions;

(c) said body defining a plurality of longitudinal releasable locking channels extending between said opposite ends of said body and being angularly spaced from one another circumferentially about said body and aligned generally parallel to, radially outwardly from, and along said longitudinal axis of said body;

(d) each of said protrusions being mounted to said body adjacent to one of said pair of opposite ends of said body, one of said protrusions of one main strut member being capable of snapping into and unsnapping from a connection joint with said channel of another main strut member at any location along said channel; and (e) a plurality of panel members having a flat wall of generally square configuration defining two pairs of opposing edges, each of said panel members including a plurality of main and auxiliary projections provided on said opposing edges and a plurality of protuberances mounted on one side of said each panel member with a pair of said protuberances being mounted in spaced relation from one another on each of said main projections and one of said protuberances being mounted on each of said auxiliary projections.

2. The construction set of claim 1 wherein each of said protrusions has an outer tip of wedge-shaped cross-sectional configuration and an inner base of semi-cylindrical cross-sectional configuration, said inner base being of maximum width tapering to said outer tip of minimum width.

3. The construction set of claim 2 wherein said semi-cylindrical base of each of said protrusions and interior surface portions of one of said channels have respective grooves and ridges which interfit with one another when said protrusion is snapped into said locking channel to form said connection joint.

4. The construction set of claim 2 wherein each of said channels of said body has a pair of opposite edges being spaced apart from one another through a distance greater than the minimum width of said outer tip of the protrusion but less than the maximum width of said inner base of said protrusion.

5. The construction set of claim 1, wherein:

each channel has a C-shaped cross-sectional configuration facing radially outward from said longitudinal axis of said body; and each of said protrusions is of wedge-shaped cross-sectional configuration.

6. The construction set of claim 5 wherein each of said protrusions has an outer tip of wedge-shaped cross-sectional configuration and an inner base of semi-cylindrical cross-sectional configuration, said inner base being of maximum width tapering to said outer tip of minimum width.

7. The construction set of claim 6 wherein said elongated body of said main strut member is composed of four cylindrical hollow tubes being adhered together in back-to-back relation, each tube having a longitudinal central passage and a slot extending between opposite open ends of said tube and defining said channel, said slot being defined by opposing longitudinal edge portions of said tube.

8. The construction set of claim 7 wherein said longitudinal edge portions of said tube defining said longitudinal slot are spaced apart from one another through a distance greater than the minimum width of said outer tip of the protrusion but less than the maximum width of said inner base of said protrusion.

9. The construction set of claim 7 wherein said base of each of said protrusions and interior surface portions of said edge portions of said tube defining said slot to said channels have respective grooves and ridges which interfit with one another when said protrusion is snapped into said locking channel to form said connection joint.

10. The construction set of claim 1 further comprising:

a plurality of auxiliary strut members, each being composed of an elongated body having a longitudinal axis and a pair of opposite ends, and including a pair of protrusions;

said body defining a plurality of longitudinal releasable locking channels extending between said opposite ends of said body and being angularly spaced from one another circumferentially about said body and aligned generally parallel to, radially outwardly from, and along said longitudinal axis of said body;

one of said protrusions of one of said auxiliary strut members being capable of snapping into and unsnapping from a connection joint with said channel of another of said auxiliary strut member at any location along said channel.

11. The construction set of claim 10 wherein said locking channels and protrusions of said auxiliary strut members being substantially the same in cross-sectional configurations and sizes, and said connection joints formed between them, as said protrusions, locking channels and connection joints of said main strut members, said auxiliary strut member being shorter in length than said main strut member.

12. The construction set of claim 1 further comprising:

a plurality of articulated strut members, each being composed of a pair of opposite body portions each identical to said body of said main strut member except shorter in length;

each said articulated strut member including a hinge attached to and pivotally connecting together adjacent ends of said opposite body portions.

13. The construction set of claim 12 wherein said hinge includes a pair of tabs and a coupling pin pivotally connecting said tabs together at free ends thereof, each said tab is rigidly mounted to and extends axially from one of said adjacent ends of said body portions.

14. The construction set of claim 13 wherein said articulated strut member includes a protrusion mounted to said body portion at an opposite end thereof from said hinge, said protrusion being identical to said protrusion of said main strut member.

15. The construction set of claim 1 further comprising:

a plurality of inline connector members each composed of an elongated body defining a plurality of longitudinal releasable locking channels aligned generally parallel to, radially outwardly from, and along the longitudinal axis of said body, said locking channels of said inline connector member being substantially the same in cross-sectional configurations and sizes as said locking channels of said main strut member, said connector member being shorter in length than said main strut member.

16. The construction set of claim 1 wherein each of said main projections is formed at a central location on one of edges of said pairs thereof and wherein pairs of said auxiliary projections are formed at respective opposite end locations on each of said edges of said pairs thereof.

17. The construction set of claim 16 wherein the distance between said auxiliary projections is slightly greater than the length of one of said main projections such that two panel members can be placed edge-to-edge adjacent to one another with said main projection of one of said panel members mated with said auxiliary projections of the other of said panel members.

18. The construction set of claim 1 wherein each said protuberance has an outer spherical head capable of snap fitting into said channels on said main strut members.

19. A construction set, comprising:

(a) a plurality of main strut members;

(b) each of said main strut members being composed of an elongated body having a longitudinal axis and a pair of opposite ends, and including a pair of protrusions;

(c) said body defining a plurality of longitudinal releasable locking channels extending between said opposite ends of said body and being angularly spaced from one another circumferentially about said body and aligned generally parallel to, radially outwardly from, and along said longitudinal axis of said body;

(d) each protrusion being mounted to said body adjacent to one of said pair of opposite ends of said body, one of said protrusions of one main strut member being capable of snapping into and unsnapping from a connection joint with said channel of another main strut member at any location along said channel; and (e) a plurality of wheel members each composed of inner and outer rings mounted to one another for relative rotation about an axis of said wheel member, said inner ring being capable of receiving one of said main strut members in an interfitted relationship anywhere along the length of said main strut member.

20. The construction set of claim 19 wherein said outer ring is composed of a circular hub and a plurality of locking channels extending between opposite ends of said hub and being angularly spaced from one another circumferentially about said hub and aligned generally parallel to, radially outwardly from, and along said longitudinal axis of said wheel member body, said channels of said wheel member being identical in size and configuration to said channels of said main strut member such that said channels of said wheel member can receive said protrusions of said main strut member to form an identical connection joint therewith.

* * * * *